United States Patent [19]

Brown et al.

[11] Patent Number: 5,010,596

[45] Date of Patent: Apr. 30, 1991

[54] CONFORMABLE WEIGHTED CONDITIONING GARMENT

[76] Inventors: Darryl L. Brown, 349 E. Piru St., Los Angeles, Calif. 90061; Terence Kirkpatrick, 15910 N. Bend Ct., Houston, Tex. 77073

[21] Appl. No.: 542,820

[22] Filed: Jun. 25, 1990

[51] Int. Cl.[5] ..... A41D 1/08; A41D 1/06; A63B 21/00

[52] U.S. Cl. ..... 2/228; 2/227; 2/238; 2/247; 2/250; 272/119

[58] Field of Search ..... 2/228, 2, 227, 238, 2/247, 250; 272/119

[56] References Cited

U.S. PATENT DOCUMENTS

| | | | |
|---|---|---|---|
| 3,731,319 | 5/1973 | O'Neill | 2/2.1 R |
| 3,759,510 | 9/1973 | Jackson, Jr. | 272/57 R |
| 4,065,814 | 1/1978 | Fox | 2/79 |
| 4,268,917 | 5/1981 | Massey | 2/102 |
| 4,303,239 | 12/1981 | Walsh, Jr. | 272/119 |
| 4,344,620 | 8/1982 | Debski | 272/119 |
| 4,356,569 | 11/1982 | Sullivan | 2/2.5 |
| 4,382,302 | 5/1983 | Watson | 272/119 |
| 4,384,369 | 5/1983 | Prince | 2/79 |
| 4,407,497 | 10/1983 | Gracie | 2/67 |
| 4,602,387 | 7/1986 | Zakrzewski | 272/119 |
| 4,658,442 | 4/1987 | Tomlinson et al. | 272/119 |
| 4,946,453 | 8/1990 | Monson | 2/2.1 R |
| 4,958,386 | 9/1990 | Louis-Jeune | 2/227 |

FOREIGN PATENT DOCUMENTS

| | | | |
|---|---|---|---|
| 218063 | 1/1968 | U.S.S.R. | 2/108 |

OTHER PUBLICATIONS

Cross Training Neoprene Suit, Joe Weider's *Shape* Magazine, Nov. 1990, p. 53.

*Primary Examiner*—Werner H. Schroeder
*Assistant Examiner*—Gloria Hale
*Attorney, Agent, or Firm*—Charles H. Thomas

[57] ABSTRACT

A garment is provided for improving physical conditioning. The garment is formed with shorts having thigh encasing leg sections extending downwardly from a waist to surround and resiliently conform to the thighs of a wearer. A plurality of pouches are defined in each of the thigh encasing leg sections and are spaced laterally apart about the front, rear and outer thigh areas of the leg sections. A plurality of solid plastic encased lead weights are deployed and gripped within at least selected ones of the pouches. The leg sections are preferable secured about the legs of the wearer above the knees by adjustable belts located in hems at the lower extremities of the leg sections. The conforming nature of the garment and the way in which the weights are snugly gripped in the pockets ensures that the weights do not move relative to the wearer's skin, and do not bobble or shift as the wearer runs or engages in other physical conditioning activities.

20 Claims, 3 Drawing Sheets

CONFORMABLE WEIGHTED CONDITIONING GARMENT

BACKGROUND OF THE INVENTION

1. Field of the Invention

The present invention relates to an improved training garment for physical conditioning of muscle groups.

2. Description of the Prior Art

In modern times the population at large has increasingly become aware of the importance of physical conditioning as a program for maintaining and improving a person's health generally, for improving physical prowess in sporting activities, and also for improving physical appearance. While engaging in physical conditioning activities individuals have historically worn lightweight, moisture absorbent loose fitting garments both for comfort while engaging in physical exertion and training and to promote the evaporation of perspiration which occurs during such activities. A large market has long existed for conventional garments employed in exercising, such as jogging shorts and shirts, sweatshirts, sweat pants and jogging suits. However, the construction and purpose of such prior art garments has been solely to enhance the comfort of an individual engaging in physical training, not to improve physical conditioning.

Some attempts have been made to provide garments to aid in the development of muscles while training. For example, U.S. Pat. No. 4,384,369 discloses an exercise suit formed of nylon and having vinyl pockets adapted to carry a liquid, such as water. The weight of the liquid in each pocket or bag may be varied by fully or partially filling the bags and pockets with water. However, due to the lack of any cohesive shape to the liquid in the pockets, the liquid shifts excessively relative to the body of the wearer as the wearer engages in physical activity. Furthermore, the garment itself shifts relative to the skin of the wearer and is only secured at certain locations by a lacing system that attempts to fasten the weight load against the body. However, the laces employed hold the garment to the body only by exerting tension on the garment material to draw the garment tightly against the wearer's body. This tension varies considerably as a person moves, thus allowing the garment material to shift across the surface of a wearer's body. Furthermore, because the weight is carried in liquid form, it sloshes and gurgles as it shifts relative to the wearer's skin.

U.S. Pat. No. 4,268,917 is directed to a variably weighted vest that is used for exercise in jogging, skating, bicycling and horseback riding. The vest is provided with pockets for receiving material such as sand, pebbles, small stones or even coins. This device likewise suffers from the defect of shifting of the material of the garment relative to the body, and from shifting of the weight material within the garment. U.S. Pat. No. 4,602,387 discloses another weight vest designed for use by athletes for the purpose of weight resistance training. This weight vest employs solid steel weights, but these also are allowed to shift within the pockets in which they are employed. The canvas and foam material of which the garment is constructed is restrained from shifting relative to the wearer's body only by side straps and strap rings. Furthermore, the devices of the '917 and the '387 patents employ weights only in the area of the wearer's upper torso.

SUMMARY OF THE INVENTION

In one broad aspect the present invention is a garment for physical conditioning comprising a pair of leg sections constructed of a flexible, stretchable material for encompassing and hugging the thighs of a wearer. Each of the leg sections is formed with a plurality of pouches spaced laterally apart adjacent the thighs of a wearer with a plurality of separate weights disposed in at least some of the pouches and immobilized therewithin. The flexible material is preferably comprised of a laminated neoprene core having inner and outer opposite surfaces respectively faced with an inner layer of nylon and an outer layer of lycra or nylon fabric. The flexible, stretchable material is preferably perforated throughout by a multiplicity of small perforations to allow dissipation and evaporation of perspiration.

To form the pouches at least one, and preferably a plurality of panels, are fastened against the inner surface of the laminated neoprene. The panels may also be formed of neoprene material, but preferably are formed of layers of expanded chloroprene rubber sponge known in the trade as Biorubber and manufactured by Yamamoto Corporation of Osaka, Japan. The Biorubber panels are placed in various strategic areas adjacent to large muscle groups such as the thigh and posterior. The panels are secured to the laminated neoprene by a matrix of spaced lines of stitching that pass through the layer of expanded chloroprene rubber sponge and the inner and outer layers as well as the neoprene core so that the matrix of lines of stitching forms the pouches. The upper margin of each of the panels is turned inwardly against the layer of nylon to define flaps for the pouches. These flaps are used for capturing and holding the weights within the pouches. The weights are preferably formed of lead ingots coated with plastic.

The composite structure of the material forming the garment is resilient, stretchable and flexible, so that the garment conforms and adheres to the body of the wearer. The neoprene core provides the garment of the invention with excellent resilient properties and provides form-fitting, therapeutic support that flexes with the movement of the muscles of the wearer, yet grips the wearer's body with sufficient strength to reduce muscle fatigue. The perforated structure of the garment serves to absorb and transfer moisture from the body of the wearer to the exterior of the garment where it can evaporate. The inner nylon layer and the Biorubber panels cling to the skin of the wearer, and reduce chafing which might otherwise occur.

The pouches in the garment in which the weights are carried reside adjacent to the front, back and outer surfaces of the thighs beneath the hips of a wearer. The weights in the pouches form a supplemental body load which, through muscular adaptation, builds strength and endurance by placing resistance on specific muscle groups throughout the lower extremities by virtue of strategic weight load placement. The positioning of the weights in the leg sections thus aids in building stronger quadriceps, hamstrings, buttocks, calves, and abdominal muscles.

The lower extremity of the human body contains the largest and most powerful muscle masses in the body. The lower extremity may be considered to be comprised of the hips, thighs, legs, calves and feet. The muscles in the lower extremity of the human body are capable of generating incredible force as demonstrated by such physical movements as kicking, running and jumping. Well conditioned athletes can kick a ball over 100 yards, run 100 meters in ten seconds or less, or high jump more than 7 feet in the air.

In all of the embodiments of the invention at least seventy percent of the possible capacity of weight load is placed circumambiently adjacent the lower thigh area, just above the knee. This placement of weights serves to build up muscle groups in the lower extremity of the body which are different muscle groups than those toward which prior weighted exercise garments have been directed. The placement of the weights in the garment of the present invention targets significant muscles in the lower body extremity for development in response to carrying the artificial load presented by the weight. These muscles include the psoas major, iliacus, pectineus, sartorius, and rectus femoris. These posterior muscle groups act at the hip in extension movements.

The placement of the weights in the garment of the invention also builds up the gluteus maximus, as well as muscles of the hamstrings such as the biceps femoris, simitendinosus and semimembranosus. When the knee is flexed, such as in running and knee lift exercises, the garment of the invention serves to build up anterior muscles acting at the knee, such as the vastus lateralis, vastus intermedius and vastus medialis. The garment of the invention also aids in developing posterior muscles such as the popliteus and plantaris which act at the knee during the performance of extension movement. The weight placement in the garment also improves the extrinsic posterior muscle groups which act at the ankle and foot in plantar flexion movements of the foot. These extrinsic posterior muscle groups include gatrocnemius, soleus, flexor digitorum longus, tibilis posterior and flexor hallucis longus.

The perforated neoprene core, which is preferably fabric lined, provides many desirable features. The flexible, resilient coated neoprene core provides moisture absorbency and ventilation for heat and perspiration dissipation. The flexible softness and body hugging capability of the improved physical conditioning garment is rectus femoris. These posterior muscle groups act at the hip in extension movements.

The placement of the weights in the garment of the invention also builds up the gluteus maximus, as well as muscles of the hamstrings such as the biceps femoris, simitendinosus and semimembranosus. When the knee is flexed, such as in running and knee lift exercises, the garment of the invention serves to build up anterior muscles acting at the knee, such as the vastus lateralis, vastus intermedius and vastus medialis. The garment of the invention also aids in developing posterior muscles such as the popliteus and plantaris which act at the knee during the performance of extension movement. The weight placement in the garment also improves the extrinsic posterior muscle groups which act at the ankle and foot in plantar flexion movements of the foot. These extrinsic posterior muscle groups include gatrocnemius, soleus, flexor digitorum longus, tibilis posterior and flexor hallucis longus.

The perforated neoprene core, which is preferably fabric lined, provides many desirable features. The flexible, resilient coated neoprene core provides moisture absorbency and ventilation for heat and perspiration dissipation. The flexible softness and body hugging capability of the improved physical conditioning garment is mainly attributable to the resiliency of the material of which it is formed. The thermal properties of the garment provide both warmth and comfort. Furthermore, the garment is buoyant which makes it useful for aquatic activities, as well as activities conducted in the atmosphere.

The neoprene core of the material of the garment may be sandwiched between various high technology layers by lamination. Interior fabric linings may be formed of nylon, of the type sold as Thinsulate by 3M Corporation and Themax which is sold by Dupont Corporation. The exterior layer of the material may be formed of fabric linings typically used in stretched jerseys, such as lycra, terry cloth and plush, or waterproof breathable systems such as Thintech which is sold by 3M Corporation and Gore-Tex. The outer layer may also be formed of fluorescent nylon to enhance visibility at night. Waterproof breathable stretch fabric laminations may also well find utility as exterior layers on the neoprene core.

The panels which are sewn to the neoprene core are preferably formed of Biorubber "Type P", which is a type of neoprene available from Yamamoto Corporation. Biorubber "Type P" is said to affect the muscle cells of the body by emitting an energy wave form that essentially impacts on the molecular structure of the human muscle cell causing muscular change and consequential changes of the cells. This effect creates greater strength and duration in the use of human muscles subjected to contact with Biorubber "Type P". The Biorubber also increases the resistance of the human body to loss of body heat. Thus, the Biorubber panels effortlessly retain some body heat within the garment, thereby causing the wearer to perspire and burn off fat.

The weights which are employed in the pouches of the invention are preferably formed of lead coated with plastic. The weights are formed as lead ingots upon which a coating of smooth, non-irritating, washable vinyl is cast. Lead provides a high weight density and is soft and flexible. Also, lead can be molded into different forms and shapes.

Approximately forty pounds of lead weights formed as lead ingots each weighing about four and one half to five ounces are distributed throughout the garment in very strategic locations. Preferably, a total of about 2.5 pounds of weights are positioned in pouches adjacent each of certain areas, such as the thigh hamstring muscles, the quadricep muscles, the stomach, the chest, and the upper back regions of the torso. Garments including torso sections with long sleeves may also be utilized and weighted in appropriate areas.

Another important feature of the invention which aids in holding the weights and the structural material of the garment immobile against the body of the wearer and which prevents the weights from bobbling and bruising the muscles is the provision of a girding band at each of the lower extremities at each of the leg sections. Preferably, the leg sections terminate just above the knee and are each comprised of a marginal hem extending about the circumference of the lower extremity of each of the leg sections to define a tunnel therethrough. A girding band extends through the tunnel to encircle and bind the hem of each lower leg section against the leg of a wearer.

An opening is preferably defined through the hem for access to the tunnel and the girding band is preferably comprised of a belt that encircles the leg and has opposite ends which protrude through the opening and are fastened together on the outside of the garment. The belt is preferably equipped with an adjustable cinch for fastening the belt ends together to adjust the length of the band of the belt that encircles the leg of the wearer. The wearer can thereby quickly and easily adjust the force with which the lower margins of the leg sections are held against the wearer's legs by adjusting the cinches on each belt. The belts can be tightened sufficiently to ensure that the pouches in the leg sections are held firmly against the thighs of the wearer, but not so tight as to constrict the flow of blood or present undue discomfort to the wearer.

In the embodiments of the invention which employ upper torso covering sections located above the leg sections, a plurality of pouches of the type described are spaced laterally apart in the upper section on both the front and rear thereof adjacent the upper torso of the wearer. The upper section may be shaped as a vest or a tank top. Separate weights of the type described are disposed in at least some of the pouches in the upper section and are gripped therewithin by the Biorubber flaps between the Biorubber panels and the inner nylon lining. In these embodiments about thirty percent of the weighted load is distributed adjacent the torso.

The invention may be described with greater clarity and particularity with reference to the accompanying drawings.

DESCRIPTION OF THE EMBODIMENTS

Figure 1:
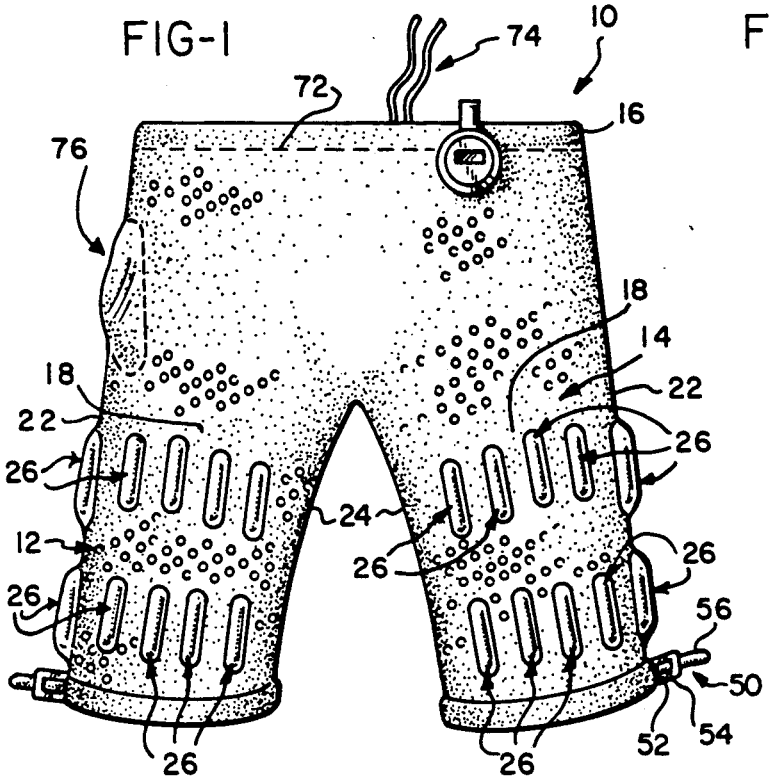
FIG. 1 is a front elevational view of one embodiment of the garment of the invention.

FIG. 1 illustrates a garment 10 for improving physical conditioning in the form of a set of shorts. The garment 10 has thigh encasing leg sections 12 and 14 extending downwardly from a waist 16. Each of the leg sections 12 and 14 has a front area 18 and a rear area 20. Each leg section 12 and 14 also has an outer thigh area 22 and an inner thigh area 24. The leg sections 12 and 14 surround and resiliently conform to the thighs of a wearer. Each thigh encasing leg section 12 and 14 has a plurality of pouches 26 defined therein. The leg sections 12 and 14 are constructed in mirror-image configuration. The pouches 26 are spaced laterally apart about the front, rear and outer thigh areas 18, 20 and 22. A plurality of solid weights 28, one of which is visible in FIG. 2, are deployed and gripped within at least selected ones of the pockets 26.

Figure 2:
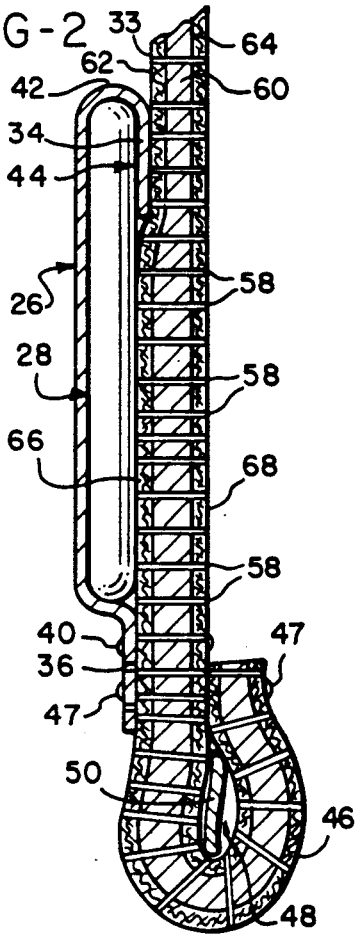
FIG. 2 is a sectional elevational detail taken along the lines 2—2 of FIG. 1A.

As best illustrated in FIG. 2, the material of the garment 10 is perforated by a multiplicity of openings 58 and is formed of an inner neoprene core 60 having inner and outer opposite surfaces 62 and 64, respectively. The inner surface 62 is faced with a laminated nylon layer 66. The outer surface 64 of the neoprene core 60 is faced with an outer laminated lycra or nylon layer 68.

The composite material of which the conditioning garment 10 is constructed fits sleekly on the wearer's body. The material is stretchable so that the interior surface 33 of the nylon layer 66 and the inwardly facing surfaces of the Biorubber panels 30 and 32 closely conform and hug the body of the wearer, and do not shift laterally thereon. Rather, the material stretches to follow the flowing movement of stretching and contracting muscles without significant lateral displacement relative to the body of the wearer.

Figure 1A:
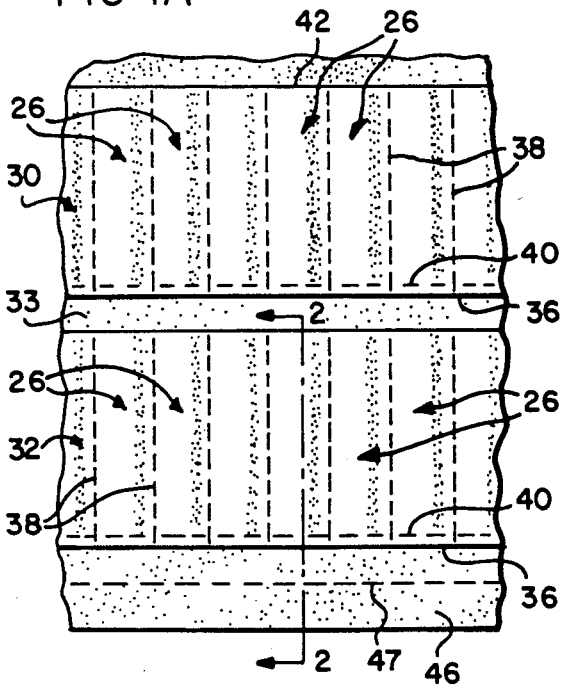
FIG. 1A is a detail of the inside surface of one of the leg sections of the garment of FIG. 1 showing the placement of Biorubber panels against the resilient, stretchable material forming one of the leg sections.

FIG. 1A is an elevational detail of the interior surface of a portion of the lower region of one of the leg sections of the garment 10 a viewed with the garment turned inside out. FIG. 1A depicts a pair of Biorubber panels 30 and 32 secured to the interior surface 33 of the front area 18 and outer thigh area 22 of one of the leg section 12 or 14. The pouches 26, the bulges of which are visible in FIG. 1, are defined between the panels 30 and 32 and the inside surface 33 of the front area 18, rear area 20 and outer thigh area 22 of the leg sections 12 and 14.

Each of the panels 30 and 32 is formed of a rectangular swathe of Biorubber material approximately four inches in width as measured in a vertical direction, and sixteen inches in length as measured in a horizontal direction. The upper margin 34 of each panel 30 and 32 is turned inwardly with a fold 42 toward the interior surface 33 of the leg section to extend back toward the lower edge 36 of the panel. The upper panel margin 34 extends a distance of about three quarters of an inch in contact with inner surface 33 extends approximately one quarter of the length of the weight 28.

The pouches 26 are defined by a matrix of spaced lines of stitching, including vertical lines of stitching 38 and horizontal lines of stitching 40. The horizontal lines of stitching 40 extend horizontally through the structure of the panels 30 and 32 closely adjacent and parallel to the lower edges 36 of the panels 30 and 32. The vertical lines of stitching 38 extend upwardly from the lower panel edges 36 and terminate approximately one quarter of an inch short of the upper fold 42 at which the upper margins 34 of the panels 30 and 32 are turned back downwardly in contact with the interior surface 33 of the front, back and outer thigh areas 18, 20 and 22 of the leg sections 12 and 14. The pouches 26 are formed between each adjacent pair of vertical lines of stitching 38 and above the horizontal line of stitching 40. The upper panel margin 34 forms a flap for the pouches 26 between vertical lines of stitching 38. One flap 44 is depicted in FIG. 2.

Each of the solid weights 28 is constructed of an ingot of lead about three inches long. The lead ingots are covered with an outer coating of a washable polyvinyl chloride plastic.

As illustrated in FIG. 1A the pouches 26 are defined in upper and lower rows by the panels 30 and 32, respectively, on the inner surface 33 of the front areas 18, rear areas 20 and the outer thigh areas 22 of the leg sections 12 and 14. A marginal hem 46 is sewn by a line of stitching 47 about the entire circumference of the lower extremity of each of the leg sections 12 and 14 to define a tunnel 48 therethrough, as illustrated in FIG. 2. The lower edge 36 of the lowermost panel 32 starts at about one inch above the hem 46 so as to position the lowermost row of pouches 26 as close to the wearer's knee as possible in order to get the maximum benefit from physical conditioning. The uppermost panel 30 is positioned about one inch above the lowermost panel 32. There are nine pouches 26 defined in each of the two rows of pouches formed by the panels 30 and 32. When all of the pouches in a row on each leg section are filled with weights, the total auxiliary weight of each row for each leg section is about three pounds. Thus, each leg section 12 and 14 carries about six pounds of auxiliary weights 26.

The tunnel 48 formed by the marginal hem 46 is adapted to receive a girding band extending therethrough to encircle and bind the hem 46 against the leg of a wearer. While the girding band could be formed as an elastic loop within the tunnel 48, a preferred construction involves the provision of a separate belt 50 secured to the lower extremity of each of the leg sections 12 and 14. The belts 50 hold the lower extremities of the hems 46 of the leg sections 12 and 14 secured in position against the legs of a wearer. An opening in the form of a vertical slot 52 is defined through each hem 46 for access to the tunnel 48.

Each belt 50 has opposite ends which protrude through the opening 52 and are fastened together on the outside of the material forming the garment 10. An adjustable cinch 54 is provided on one end of each belt 50 and is equipped with a cam fastener for clamping the opposite tail end 56 of the belt 50 to adjust the length of the encircling band formed by the belt 50 within the hem 46. The wearer adjusts the tightness of the belt 50 around each leg as desired so that the lower extremities of the leg sections 12 and 14 of the garment 10 are held securely, yet comfortably in position against the wearer's legs. This prevents the hems 46 from moving up or down the thighs of the wearer.

The waist 16 of the garment 10 is provided with an elastic band encircling the garment 10 at the waist, and is also provided with an upper waist hem defined by a line of stitching 72. The upper waist hem may be tightened snugly about the midriff of the wearer using a draw string 74 which encircles the waist 16 within the upper waist hem. A manual pedometer 75 is illustrated clipped over the upper waist hem at the waist 16 of the garment 10. As an alternative to the draw string arrangement, the front of the garment 10 could be formed with a flap extending downwardly from the waist 16 toward the crotch between the leg sections 12 and 14 to fold in overlapping relationship and remain snugly secured by means of Velcro fasteners. A side pocket 76 and rear pockets 78 are formed in the garment 10.

To insert a weight 28 into a pouch 26, the shorts 10 are turned inside out to expose the panels 30 and 32 as illustrated in FIG. 1A. The pouches 26 in which weights are to be deployed are selected and the material of the marginal edge 34 is pulled away from the inner surface 33 of the leg section to which the panel forming the selected pouch 26 is secured. The width of the portion of the marginal edge 34 which can be pulled away is limited by the adjacent lines of stitching 38. Nevertheless, a sufficient opening exists between the fold 42 and the inner surface 33 of the leg structure to allow a weight 28 to be inserted between two adjacent vertical lines of stitching 38 and between the flap 44 and the surface 33 to which that panel is attached. The weight 28 is then forced downwardly between the panel and the inner surface 33 of the leg section adjacent thereto.

Once the weight 28 has been seated at the bottom of the pouch 26, the flap portion 44 of the marginal edge 34 is distended over the top of the weight 28, to capture and hold the weight 28 in a selected pouch 26, as depicted in FIG. 2. When the weight 28 has been inserted into a pouch 26 in this manner, it is gripped firmly and held immobile against the inner surface 33 of the leg section material and will not bobble or shift within the pouch 26.

Figure 3:
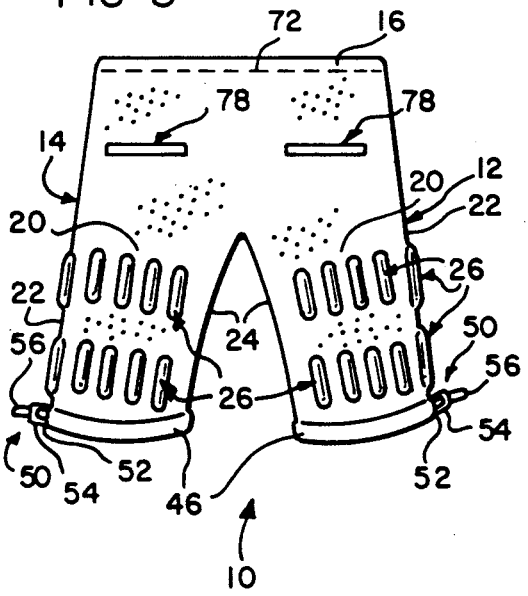
FIG. 3 is a rear elevational detail of the garment of FIG. 1.
Figure 4:
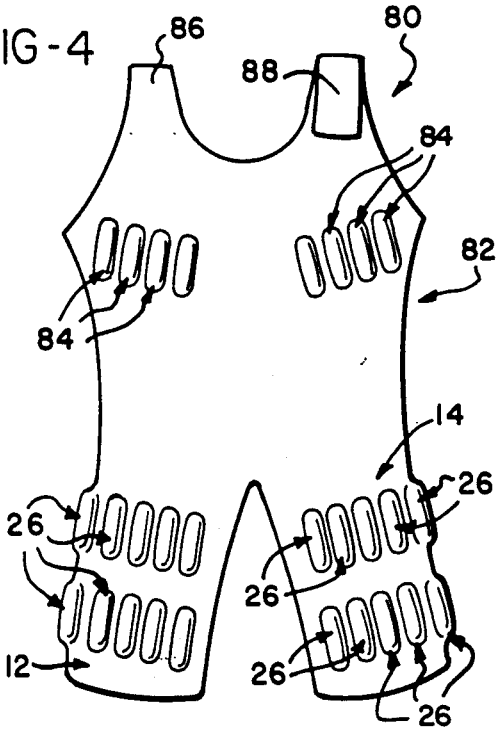
FIG. 4 is a front elevational view of one alternative embodiment of the garment of the invention.
Figure 5:
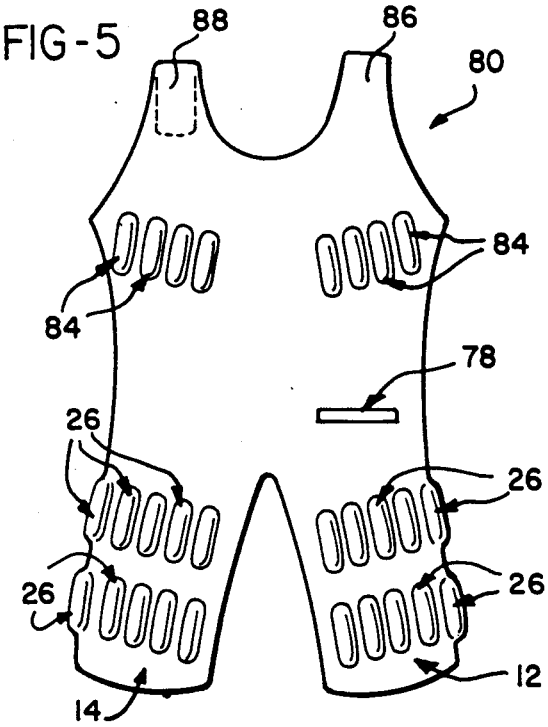
FIG. 5 is a rear elevational view of the embodiment of FIG. 4.

FIGS. 4 and 5 illustrate an alternative embodiment of the invention. The garment 80 depicted in FIGS. 4 and 5 also has legs sections 12 and 14 formed with pouches 26 in the same manner as depicted and described in conjunction with FIGS. 1-3. In addition, the garment 80 is further comprised of a tank top section 82 integrally formed with the leg sections 12 and 14. The garment 80 includes a fixed shoulder strap 86 and a releasable shoulder strap 88 that is secured to the upper torso portion 82 by means of Velcro fasteners. The tank top section 82 is comprised of a plurality of pouches 84 spaced laterally apart in the pectoral area as depicted in FIG. 4 and in the upper back regions as illustrated in FIG. 5. The pouches 84 are formed in the same manner as the pouches 26, as depicted and described in association with FIGS. 1A and 2. The pouches 84 on the left-hand side of the garment 80 typically carry a total of about two and one half pounds of weights 28 in the aggregate, while the pouches 84 on the right-hand side of the garment 80 likewise carry a total of about two and one half pounds of weights 28, when filled to capacity.

Figure 6:
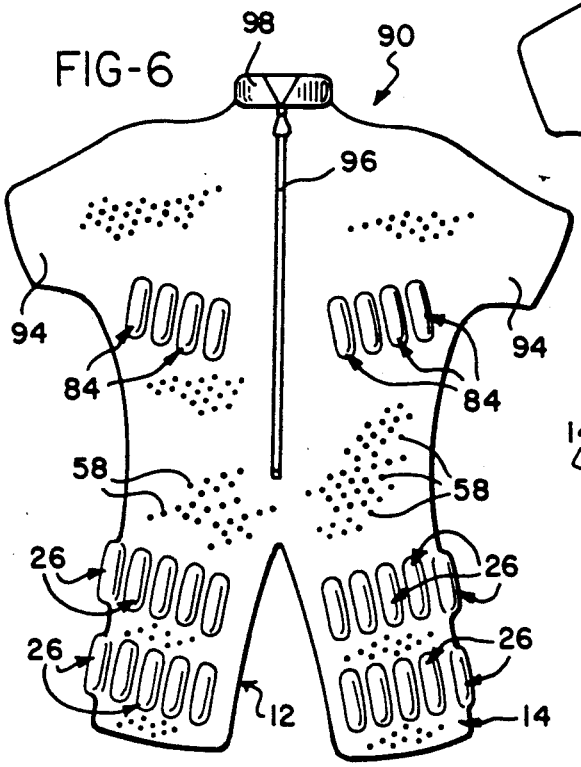
FIG. 6 is a front elevational view of still another alternative embodiment of the garment of the invention.
Figure 7:
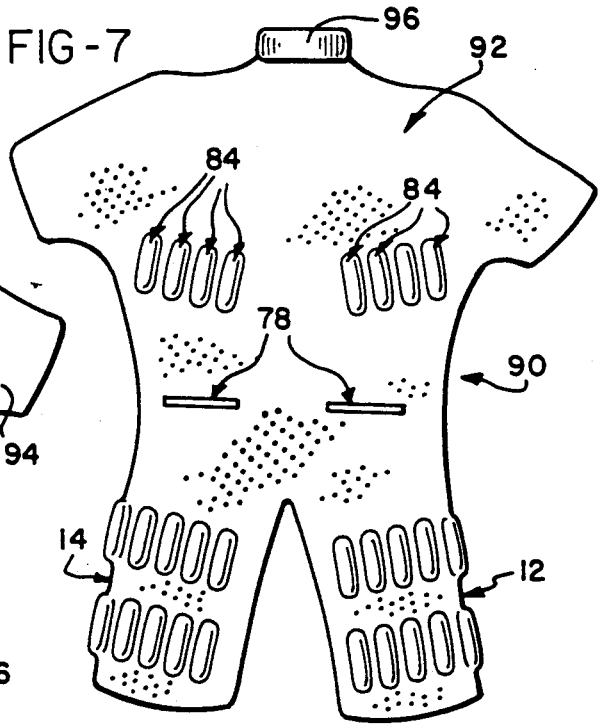
FIG. 7 is a rear elevational view of the embodiment of FIG. 6.

FIGS. 6 and 7 illustrate still another embodiment 90 of the conditioning garment of the invention. The garment 90 is comprised of a vest section 92 located above and integrally formed with the leg sections 12 and 14. The garment 90 is comprised of a plurality of pockets 84 in the torso section, the same as in the garment 80. The pouches 84 are spaced laterally apart in the vest section 92 on both the front and rear thereof, as indicated respectively in FIGS. 6 and 7. Separate weights 28 are disposed in at least some of the pouches 84 and are gripped therewithin by the flexible, resilient material as previously described. The garment 90 differs from the garment 80 in that it also includes short sleeves 94 for added warmth and is closed by a vertical zipper 96 that extends downwardly from a collar 98 into the waist area of the garment 90.

Figure 8:
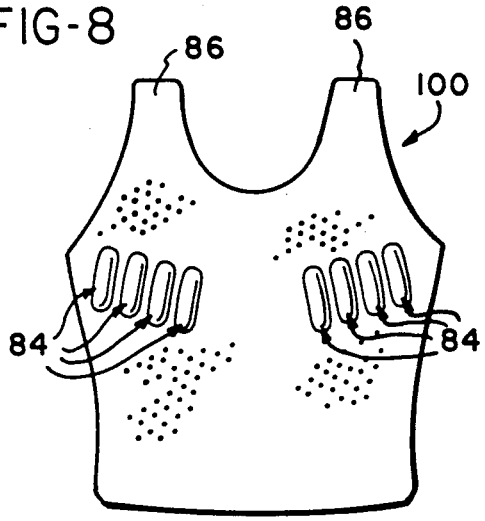
FIG. 8 is a front elevational view of still another alternative and modified embodiment of the garment of the invention.
Figure 9:
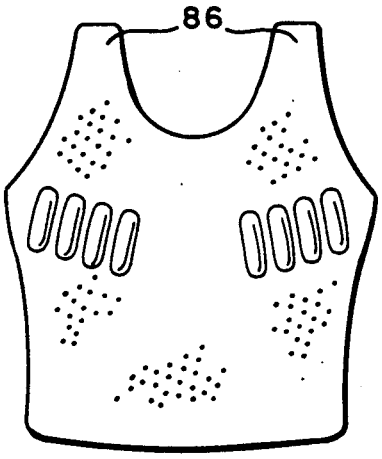
FIG. 9 is a rear elevational view of the embodiment of FIG. 8.
Figure 11:
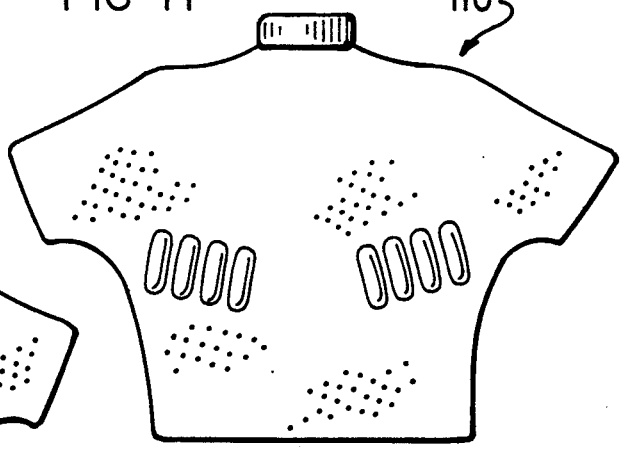
FIG. 11 is a rear elevational view of the embodiment of FIG. 10.
Figure 10:
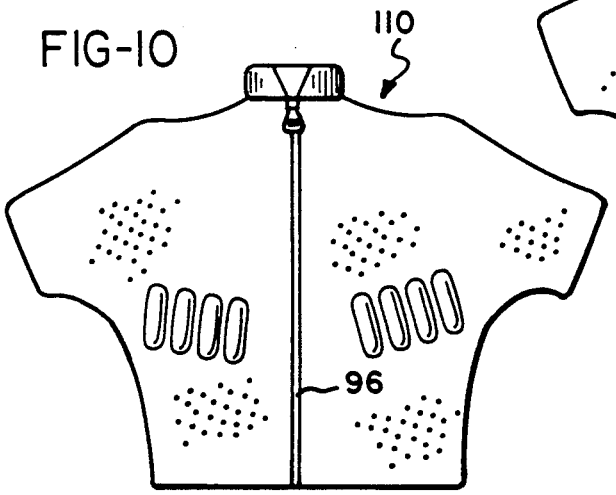
FIG. 10 is a front elevational view of still another alternative and modified embodiment of the garment of the invention.

FIGS. 8 and 9 illustrate yet another modification of the invention. A physical conditioning singlet tank top 100 is provided with a plurality of pouches 84 in which weights 28 can be selectively inserted. The tank top 100 is identical in construction to the tank top section 80 of the embodiment of FIGS. 4-5 with the exception that both of the straps are fixed shoulder straps 86. FIGS. 10 and 11 illustrate a physical conditioning singlet vest 110 which is identical in construction to the vest section 92 of the garment 90 depicted in FIGS. 6-7.

The various embodiments of the conditioning garment of the invention provide a means for filling and meeting the needs of athletic and sports training which require muscle conditioning. Such training must first be individualized according to the goals and existing strengths and skills of the individual. Next, the intensity of training must be increased to make progress. Finally, the training must be varied and a wide range of training methods and programs must be used to develop all elements of fitness and athletic ability to avoid stagnation at training plateaus. The conditioning garment of the invention meets all aspects of these needs. The garment can either be worn as outer wear or as underwear to provide significantly greater cardiovascular exercise than prior art exercise garments. The improved conditioning garment of the invention uniformly exercises more muscles and aids in maintaining flexibility and strength while giving an exceptionally efficient aerobic workouts.

The conditioning garment of the invention is an ideal conditioning aid for all types of sporting and athletic activities, such as football, soccer, biking, baseball, volleyball, cycling, basketball, gymnastics, and tennis, as well as all track, field and racing events such as hurdles, sprints, distance, biathlon, decathlon, triathlon, etc. In addition to providing a unique means for conditioning one's body for competitive sports, the conditioning suit of the invention enables a person to develop a stronger, more supple and more durable body.

The recommended method of training using the conditioning suit of the invention is in low impact exercises, such as aquatic aerobics, running in water in a pool, cycling, walking, calisthenics, steep hill climbing and flat runs on soft surfaces only, preferably grass and beach sand. This type of conditioning greatly reduces the risk of injury, particularly in view of the additional weight employed, by reducing stress from impact on knees, ankles and feet.

Undoubtedly, numerous variations and modifications of the invention will become readily apparent to those involved in physical conditioning. Accordingly, the scope of the invention should not be construed as limited to the specific embodiments depicted and described in the drawings, but rather is defined in the claims appended hereto.

We claim:

1. A garment for physical conditioning comprising a pair of leg and thigh sections constructed of a flexible, stretchable material for encompassing and hugging the thighs of a wearer wherein each of said leg sections is formed with a plurality of pouches spaced laterally apart adjacent the thighs of a wearer and a plurality of weights disposed separately in at least some of said pouches and being immobilized therewithin.

2. A garment according to claim 1 wherein said flexible material is comprised of a laminated neoprene core having inner and outer opposite surfaces respectively faced with inner and outer layers.

3. A garment according to claim 2 wherein said inner layer is comprised of nylon.

4. A garment according to claim 3 further comprising at least one panel formed of a layer of expanded chloroprene rubber sponge secured to said laminated core by a matrix of spaced lines of stitching through said layer of expanded chloroprene rubber sponge and through said inner and outer layers of said core, and said matrix of lines of stitching form said pouches.

5. A garment according to claim 4 wherein said outer layer is formed of spandex.

6. A garment according to claim 5 wherein said flexible, stretchable material is perforated.

7. A garment according to claim 1 wherein said garment is a pair of shorts, the leg sections terminating above the knee, and further comprising a marginal hem extending about a circumference of a lower extremity of each of said leg sections to define a tunnel therethrough, and a girding band extending through said tunnel to encircle and bind said hem against the leg of a wearer.

8. A garment according to claim 7 wherein an outside opening is defined through said hem for access to said tunnel, and said girding band is comprised of a belt having opposite ends protruding through said opening and are fastened together on the outside of said material.

9. A garment according to claim 7 further comprising an adjustable cinch for fastening said ends of said belt together to adjust a length of said band.

10. A garment according to claim 1 further comprising a vest section having a front and a back, and located above said leg sections and further comprising a plurality of pouches spaced laterally apart in said vest section on both the front and rear thereof and weights are disposed separately in at least some of said pouches of said vest section and immobilized therewithin.

11. A garment according to claim 1 further comprising a tank top section having a front and back, and located above said leg sections and further comprising a plurality of pouches spaced laterally apart in said tank top section on both the front and rear thereof and weights are disposed separately in at least some of said pouches of said tank top section and are immobilized therewithin.

12. A garment according to claim 1 further characterized in that said weights are comprised of lead ingots coated with plastic.

13. A garment for use in physical conditioning comprising upper leg sections formed of a flexible stretchable resilient material and which hug and surround the thighs of a wearer and in which a plurality of pouches are defined to reside adjacent to the fronts, backs and outer areas of the thighs of a wearer, and a plurality of solid weights gripped within the confines of selected ones of said pouches by the resiliency of said material.

14. A garment according to claim 13 wherein said material is formed of a plurality of layers and is perforated and further comprised of an outer layer of fabric, an intermediate layer of neoprene, and an inner layer of nylon.

15. A garment according to claim 14 further comprising at least one panel formed of expanded chloroprene rubber sponge, and said pouches are defined between said panel and said layer of nylon.

16. A garment according to claim 15 wherein an upper margin of each of said panels is turned inwardly against said layer of nylon, and each of said panels is sewn to said plurality of layers by a matrix of stitching to define said pouches, and said upper margins of said panels define flaps for said pouches for capturing and holding said weights in said pouches.

17. A garment according to claim 13 wherein said garment is comprised of a pair of shorts and said leg sections terminate above the knees of the wearer, and further comprising a separate belt secured to the lower extremity of each of said leg sections for holding said lower extremities of said leg sections secured in position against the leg of a wearer.

18. A garment according to claim 13 wherein said weights are comprised of ingots of metal encased in plastic.

19. A garment for improving physical conditioning comprising shorts having thigh encasing leg sections extending downwardly from a waist and having front and rear areas and outer and inner thigh areas to surround and resiliently conform to the thighs of a wearer, each thigh encasing leg section having a plurality of pouches defined therein and spaced laterally apart about said front, rear and outer thigh areas, and a plurality of solid weights deployed and gripped within at least selected ones of said pouches.

20. A garment according to claim 19 further characterized in that said pouches are defined in upper and lower rows about said front, rear and outer thigh areas of said leg sections.

* * * * *